US006364997B1

(12) United States Patent
Dagan et al.

(10) Patent No.: US 6,364,997 B1
(45) Date of Patent: Apr. 2, 2002

(54) RAW STOCK FOR PHOTOGRAPHIC PAPER

(75) Inventors: Sandra J. Dagan, Churchville; Thaddeus S. Gula, Rochester; Robert P. Bourdelais, Pittsford; Peter T. Aylward, Hilton, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/552,937

(22) Filed: Apr. 20, 2000

Related U.S. Application Data

(62) Division of application No. 09/094,159, filed on Jun. 9, 1998, now Pat. No. 6,107,014.

(51) Int. Cl.[7] ..... D21C 9/00

(52) U.S. Cl. ..... 162/9; 162/26; 162/136; 162/202; 162/13; 162/23; 162/206; 430/536; 430/538; 430/496; 428/319.9; 428/337; 347/106; 421/28

(58) Field of Search ..... 430/538, 536, 430/496, 950; 428/319.9, 337, 513, 537.5; 347/106; 162/142, 136, 146, 157.6, 130, 145, 137, 26, 23, 202; 421/28

(56) References Cited

U.S. PATENT DOCUMENTS

| | | | | |
|---|---|---|---|---|
| 3,841,943 A | | 10/1974 | Takushi et al. | |
| 3,944,699 A | | 3/1976 | Mathews et al. | |
| 4,187,113 A | | 2/1980 | Mathews et al. | |
| 4,283,486 A | | 8/1981 | Aono et al. | |
| 4,377,616 A | | 3/1983 | Ashcraft et al. | |
| 4,582,785 A | | 4/1986 | Woodward et al. | |
| 4,632,869 A | | 12/1986 | Park et al. | |
| 4,758,462 A | | 7/1988 | Park et al. | |
| 4,774,224 A | | 9/1988 | Campbell | |
| 4,994,147 A | * | 2/1991 | Foley et al. | 162/137 |
| 5,011,814 A | | 4/1991 | Harrison | |
| 5,096,875 A | | 3/1992 | Martin | |
| 5,106,655 A | | 4/1992 | Boissevain et al. | |
| 5,122,232 A | | 6/1992 | Lyman et al. | |
| 5,126,187 A | | 6/1992 | Punton et al. | |
| 5,145,010 A | | 9/1992 | Danielson et al. | |
| 5,288,690 A | | 2/1994 | Warner et al. | |
| RE34,742 E | | 9/1994 | Maier et al. | |
| 5,389,422 A | | 2/1995 | Okazaki et al. | |
| 5,391,473 A | * | 2/1995 | Lacz et al. | 430/538 |
| 5,425,990 A | | 6/1995 | Blum et al. | |
| 5,466,519 A | | 11/1995 | Shirakura et al. | |
| 5,514,460 A | | 5/1996 | Surman et al. | |
| 5,567,473 A | * | 10/1996 | Lacz et al. | 427/211 |
| 5,888,683 A | | 3/1999 | Gula et al. | |

FOREIGN PATENT DOCUMENTS

| | | |
|---|---|---|
| EP | 0 316 081 A | 5/1989 |
| EP | 0 391 430 A | 10/1990 |
| EP | 0 510 898 A | 10/1992 |
| EP | 0 546 711 A | 6/1993 |
| EP | 0 803 377 A1 | 10/1997 |
| EP | 0 880 065 A | 11/1998 |

OTHER PUBLICATIONS

Mustafa I. Stationwala, Production of High Quality and Low Energy Chemithermomechanical pulp, Tappi Journal, vol. 77, No. 2, pp. 113–119, Feb. 1, 1994.

* cited by examiner

*Primary Examiner*—Stanley S. Silverman
*Assistant Examiner*—Mark Halpern
(74) *Attorney, Agent, or Firm*—Paul A. Leipold

(57) ABSTRACT

The invention relates to a imaging element comprising a paper having a surface roughness average of between 0.13 and 0.44 micrometers.

9 Claims, 1 Drawing Sheet

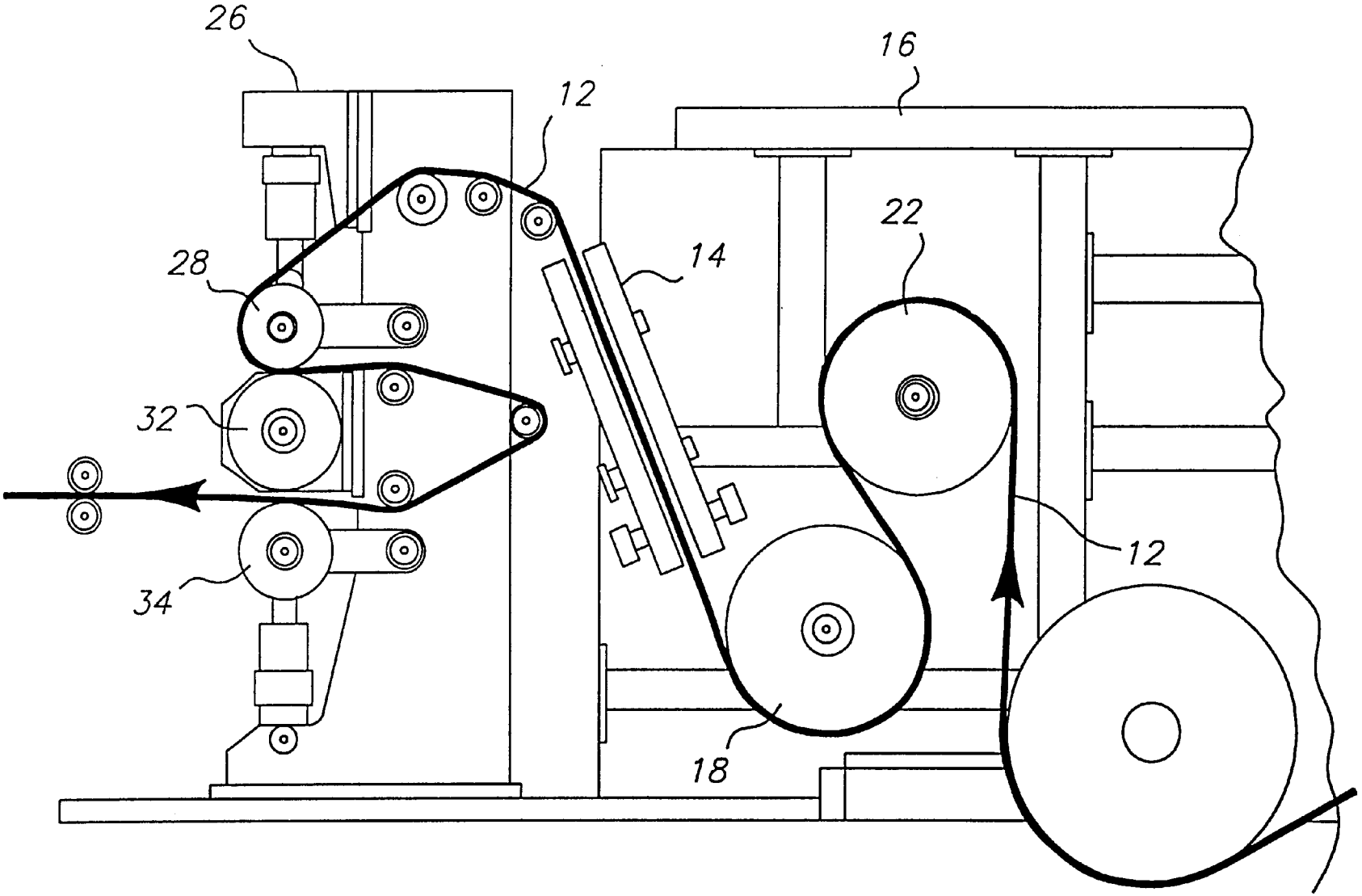
16
22
12
14
18
12
26
28
32
34

RAW STOCK FOR PHOTOGRAPHIC PAPER

This application is a divisional of Ser. No. 09/094,159 filed Jun. 9, 1998, now U.S. Pat. No. 6,107,014.

FIELD OF THE INVENTION

This invention relates to imaging materials. In a preferred form it relates to base materials for photographic papers.

BACKGROUND OF THE INVENTION

In the formation of photographic paper it is known that the base paper has applied thereto a layer of polyolefin resin, typically polyethylene. This layer serves to provide waterproofing to the paper and provide a smooth surface on which the photosensitive layers are formed. The formation of the smooth surface is controlled by both the roughness of the chill roll where the polyolefin resin is cast, the amount of resin applied to the base paper surface, and the roughness of the base paper. Since the addition of polyolefin resin to improve the surface adds significant cost to the product, it would be desirable if a smoother base paper could be made to improve the gloss of photographic paper.

In U.S. application Ser. No. 08/862,708 (Bourdelais et al.) filed May 23, 1997, a composite photographic material with laminated biaxially oriented polyolefin sheets has been proposed. While this invention does provide a solution to the sensitivity of photographic paper to humidity, it uses standard photographic base paper whose roughness is replicated on the surface of the imaging element. Traditional cellulose paper base has a particularly objectionable roughness in the spatial frequency range of 0.30 to 6.35 mm. In this spatial frequency range, a surface roughness average greater than 0.50 $\mu$m can be objectionable to consumers. Visual roughness greater than 0.50 $\mu$m is usually referred to as orange peel. It would be desirable if orange peel roughness could be minimized in the laminated photographic base paper.

Traditional photographic papers contain chemistry to provide certain properties to the paper that are not inherent in the paper fiber. This chemistry includes materials known in the art to improve wet strength and dry strength. Since photographic paper that comprises laminated biaxially oriented polyolefin sheets laminated to base paper has greatly improved tensile strength over traditional photographic papers, the addition of wet and dry strength to the paper adds unwanted cost to the product. It would be desirable if a base paper could be made that was free of wet and dry strength resins.

It has been proposed in U.S. Pat. No. 5,244,861 to utilize biaxially oriented polypropylene laminated to a base paper for use as a reflective imaging receiver for thermal dye transfer imaging. While the invention does provide an excellent material for the thermal dye transfer imaging process, this invention cannot be used for imaging systems that are gelatin based, such as silver halide and ink jet, because of the sensitivity of the gel imaging systems to humidity. The humidity sensitivity of the gel imaging layer creates unwanted imaging element curl. One factor contributing to the imaging element curl is the ratio of base paper stiffness in the machine direction to the cross direction. Traditional photographic base papers have a machine direction to cross direction stiffness ratio, as measured by Young's modulus, of approximately 2.0. For a composite photographic material with laminated biaxially oriented polyolefin sheets to a base paper, it would be desirable if the machine direction to cross direction stiffness ratio was approximately 1.6 to reduce imaging element curl.

A receiving element with cellulose paper support for use in thermal dye transfer has been proposed in U.S. Pat. No. 5,288,690 (Warner et al.). While the cellulose paper in U.S. Pat. No. 5,288,690 solved many of the problems existing with thermal dye transfer printing on a laminated cellulose paper, this cellulose paper is not suitable for a laminated cellulose photographic paper since this paper has undesirable surface roughness in the spatial frequency range of 0.30 to 6.35 mm and the pulp used in U.S. Pat. No. 5,288,690 is expensive compared to alternative pulps. It would be desirable if orange peel roughness could be minimized in the laminated photographic base paper.

Problem to be Solved by the Invention

There remains a need for a more effective base paper to provide an improved smooth surface, as well as provide a stronger photographic element and less dusting during photofinishing.

SUMMARY OF THE INVENTION

An object of the invention is to provide an imaging material that has improved surface properties.

Another object of this invention is to provide an imaging material with a more glossy surface.

A further object of this invention is to provide a base paper that generates less dusting during slitting and chopping operations.

These and other objects of the invention are generally accomplished by a paper for photographic use comprising a paper having a surface roughness average of between 0.13 and 0.44 $\mu$m.

Advantageous Effect of the Invention

The invention provides an improved paper for imaging elements. It particularly provides an improved paper for imaging elements that are smoother, generate less dust, and are low cost.

BRIEF DESCRIPTION OF THE DRAWINGS

FIG. 1 is a schematic illustration of the apparatus used to form paper used in the invention.

DETAILED DESCRIPTION OF THE INVENTION

There are numerous advantages of the invention over prior practices in the art. The invention provides an imaging element that has a smoother surface, increasing the commercial value of the imaging element. Further, the invention provides an imaging paper that is lower cost, as the basis weight of the paper and the paper chemistry are reduced compared to traditional photographic paper bases. Another advantage is the significant reduction in dust generation, as this base paper is cut in both the cross and machine directions in imaging converting applications such as the slitting of wide rolls of imaging support, punching of imaging elements as in photographic processing equipment, and chopping as in photographic finishing equipment. A further advantage is the reduction in imaging element curl over a wide range of relative humidity when compared to standard imaging element products. These and other advantages will be apparent from the detailed description below:

The terms as used herein, "top", "upper", "emulsion side", and "face" mean the side or toward the side of a photographic member bearing the imaging layers. The terms "bottom", "lower side", and "back" mean the side or toward the side of the photographic member opposite from the side bearing the photosensitive imaging layers or developed image. The term "face side" means the side opposite the side of cellulose paper formed on a fourdrinier wire. The term "wire side" means the side of cellulose paper formed adjacent to the fourdrinier wire.

Any suitable biaxially oriented polyolefin sheet may be used for the sheet on the top side of the laminated base of the invention. Microvoided composite biaxially oriented sheets are preferred and are conveniently manufactured by coextrusion of the core and surface layers, followed by biaxial orientation, whereby voids are formed around void-initiating material contained in the core layer. Such composite sheets are disclosed in U.S. Pat. Nos. 4,377,616; 4,758,462; and 4,632,869.

The core of the preferred composite sheet should be from 15 to 95% of the total thickness of the sheet, preferably from 30 to 85% of the total thickness. The nonvoided skin(s) should thus be from 5 to 85% of the sheet, preferably from 15 to 70% of the thickness.

The density (specific gravity) of the composite sheet, expressed in terms of "percent of solid density" is calculated as follows:

$$\frac{\text{Composite Sheet Density}}{\text{Polymer Density}} \times 100 = \%\ \text{of Solid Density}$$

Percent solid density should be between 45% and 100%, preferably between 67% and 100%. As the percent solid density becomes less than 67%, the composite sheet becomes less manufacturable due to a drop in tensile strength. The sheet also becomes more susceptible to physical damage.

The total thickness of the composite sheet can range from 12 to 100 $\mu$m, preferably from 20 to 70 $\mu$m. Below 20 $\mu$m, the microvoided sheets may not be thick enough to minimize any inherent non-planarity in the support and would be more difficult to manufacture. At thickness higher than 70 $\mu$m, little improvement in either surface smoothness or mechanical properties is seen, and so there is little justification for further increase in cost for extra materials.

The biaxially oriented sheets of the invention preferably have a water vapor permeability that is less than $0.85\times10^{-5}$ g/mm$^2$/day/atm. This allows faster emulsion hardening, as the laminated support of this invention greatly slows the rate of water vapor transmission from the emulsion layers during coating of the emulsions on the support. The transmission rate is measured by ASTM F1249.

"Void" is used herein to mean devoid of added solid and liquid matter, although it is likely the "voids" contain gas. The void-initiating particles which remain in the finished packaging sheet core should be from 0.1 to 10 $\mu$m in diameter, preferably round in shape, to produce voids of the desired shape and size. The size of the void is also dependent on the degree of orientation in the machine and transverse directions. Ideally, the void would assume a shape which is defined by two opposed and edge contacting concave disks. In other words, the voids tend to have a lens-like or biconvex shape. The voids are oriented so that the two major dimensions are aligned with the machine and transverse directions of the sheet. The Z-direction axis is a minor dimension and is roughly the size of the cross diameter of the voiding particle. The voids generally tend to be closed cells and, thus, there is virtually no path open from one side of the voided core to the other side through which gas or liquid can traverse.

The void-initiating material may be selected from a variety of materials and should be present in an amount of about 5 to 50% by weight based on the weight of the core matrix polymer. Preferably, the void-initiating material comprises a polymeric material. When a polymeric material is used, it may be a polymer that can be melt-mixed with the polymer from which the core matrix is made and be able to form dispersed spherical particles as the suspension is cooled down. Examples of this would include nylon dispersed in polypropylene, polybutylene terephthalate in polypropylene, or polypropylene dispersed in polyethylene terephthalate. If the polymer is preshaped and blended into the matrix polymer, the important characteristic is the size and shape of the particles. Spheres are preferred, and they can be hollow or solid. These spheres may be made from cross-inked polymers which are members selected from the group consisting of an alkenyl aromatic compound having the general formula Ar-C(R)=$CH_2$, wherein Ar represents an aromatic hydrocarbon radical, or an aromatic halohydrocarbon radical of the benzene series and R is hydrogen or the methyl radical; acrylate-type monomers include monomers of the formula $CH_2$=C(R')—C(O)(OR) wherein R is selected from the group consisting of hydrogen and an alkyl radical containing from about 1 to 12 carbon atoms and R' is selected from the group consisting of hydrogen and methyl; copolymers of vinyl chloride and vinylidene chloride, acrylonitrile and vinyl chloride, vinyl bromide, vinyl esters having formula $CH_2$=CH(O)COR, wherein R is an alkyl radical containing from 2 to 18 carbon atoms; acrylic acid, methacrylic acid, itaconic acid, citraconic acid, maleic acid, fumaric acid, oleic acid, vinylbenzoic acid; the synthetic polyester resins which are prepared by reacting terephthalic acid and dialkyl terephthalics or ester-forming derivatives thereof, with a glycol of the series $HO(CH_2)_nOH$ wherein n is a whole number within the range of 2–10 and having reactive olefinic linkages within the polymer molecule, the above-described polyesters which include copolymerized therein up to 20 percent by weight of a second acid or ester thereof having reactive olefinic unsaturation and mixtures thereof, and a cross-linking agent selected from the group consisting of divinylbenzene, diethylene glycol dimethacrylate, diallyl fumarate, diallyl phthalate and mixtures thereof.

Examples of typical monomers for making the crosslinked polymer include styrene, butyl acrylate, acrylamide, acrylonitrile, methyl methacrylate, ethylene glycol dimethacrylate, vinyl pyridine, vinyl acetate, methyl acrylate, vinylbenzyl chloride, vinylidene chloride, acrylic acid, divinylbenzene, acrylamidomethyl-propane sulfonic acid, vinyl toluene, etc. Preferably, the cross-linked polymer is polystyrene or poly(methyl methacrylate). Most preferably, it is polystyrene, and the cross-linking agent is divinylbenzene.

Processes well known in the art yield non-uniformly sized particles, characterized by broad particle size distributions. The resulting beads can be classified by screening the beads spanning the range of the original distribution of sizes. Other processes such as suspension polymerization and limited coalescence directly yield very uniformly sized particles.

The void-initiating materials may be coated with agents to facilitate voiding. Suitable agents or lubricants include colloidal silica, colloidal alumina, and metal oxides such as tin oxide and aluminum oxide. The preferred agents are colloidal silica and alumina, most preferably, silica. The cross-linked polymer having a coating of an agent may be prepared by procedures well known in the art. For example, conventional suspension polymerization processes wherein the agent is added to the suspension is preferred. As the agent, colloidal silica is preferred.

The void-initiating particles can also be inorganic spheres, including solid or hollow glass spheres, metal or ceramic beads or inorganic particles such as clay, talc, barium sulfate, and calcium carbonate. The important parameter is that the material does not chemically react with the core matrix polymer to cause one or more of the following problems: (a) alteration of the crystallization kinetics of the matrix polymer, making it difficult to orient, (b) destruction of the core matrix polymer, (c) destruction of the void-initiating particles, (d) adhesion of the void-initiating particles to the matrix polymer, or (e) generation of undesirable reaction products, such as toxic or high color moieties. The void-initiating material should not be photographically active or degrade the performance of the photographic element in which the biaxially oriented polyolefin sheet is utilized.

For the biaxially oriented sheet on the top side toward the emulsion, suitable classes of thermoplastic polymers for the biaxially oriented sheet and the core matrix-polymer of the preferred composite sheet comprise polyolefins.

Suitable polyolefins include polypropylene, polyethylene, polymethylpentene, polystyrene, polybutylene, and mixtures thereof. Polyolefin copolymers, including copolymers of propylene and ethylene such as hexene, butene, and octene are also useful. Polypropylene is preferred, as it is low in cost and has desirable strength properties.

The nonvoided skin layers of the composite sheet can be made of the same polymeric materials as listed above for the core matrix. The composite sheet can be made with skin(s) of the same polymeric material as the core matrix, or it can be made with skin(s) of different polymeric composition than the core matrix. For compatibility, an auxiliary layer can be used to promote adhesion of the skin layer to the core.

Addenda may be added to the core matrix and/or to the skins to improve the whiteness of these sheets. This would include any process which is known in the art including adding a white pigment, such as titanium dioxide, barium sulfate, clay, or calcium carbonate. This would also include adding fluorescing agents which absorb energy in the UV region and emit light largely in the blue region, or other additives which would improve the physical properties of the sheet or the manufacturability of the sheet. For photographic use, a white base with a slight bluish tint is preferred.

The coextrusion, quenching, orienting, and heat setting of these composite sheets may be effected by any process which is known in the art for producing oriented sheet, such as by a flat sheet process or a bubble or tubular process. The flat sheet process involves extruding the blend through a slit die and rapidly quenching the extruded web upon a chilled casting drum so that the core matrix polymer component of the sheet and the skin components(s) are quenched below their glass solidification temperature. The quenched sheet is then biaxially oriented by stretching in mutually perpendicular directions at a temperature above the glass transition temperature, below the melting temperature of the matrix polymers. The sheet may be stretched in one direction and then in a second direction or may be simultaneously stretched in both directions. After the sheet has been stretched, it is heat set by heating to a temperature sufficient to crystallize or anneal the polymers while restraining to some degree the sheet against retraction in both directions of stretching.

The composite sheet, while described as having preferably at least three layers of a microvoided core and a skin layer on each side, may also be provided with additional layers that may serve to change the properties of the biaxially oriented sheet. A different effect may be achieved by additional layers. Such layers might contain tints, antistatic materials, or different void-making materials to produce sheets of unique properties. Biaxially oriented sheets could be formed with surface layers that would provide improved adhesion or appearance to the support and photographic element. The biaxially oriented extrusion could be carried out with as many as 10 layers if desired to achieve some particular desired property.

These composite sheets may be coated or treated after the coextrusion and orienting process or between casting and full orientation with any number of coatings which may be used to improve the properties of the sheets including printability, to provide a vapor barrier, to make them heat sealable, or to improve the adhesion to the support or to the photosensitive layers. Examples of this would be acrylic coatings for printability and coating polyvinylidene chloride for heat seal properties. Further examples include flame, plasma, or corona discharge treatment to improve printability or adhesion.

By having at least one nonvoided skin on the microvoided core, the tensile strength of the sheet is increased, thus making the sheet more manufacturable. It also allows the sheets to be made at wider widths and higher draw ratios than when sheets are made with all layers voided. Coextruding the layers further simplifies the manufacturing process.

The structure of a typical biaxially oriented, microvoided sheet of the invention is as follows:

Solid skin layer
Microvoided core layer
olid skin layer

The sheet on the side of the base paper opposite to the emulsion layers may be any suitable biaxially oriented polymer sheet. The sheet may or may not be microvoided. It may have the same composition as the sheet on the top side of the paper backing material. Biaxially oriented sheets are conveniently manufactured by coextrusion of the sheet, which may contain several layers, followed by biaxial orientation. Such biaxially oriented sheets are disclosed in, for example, U.S. Pat. No. 4,764,425, the disclosure of which is incorporated by reference.

Suitable classes of thermoplastic polymers for the biaxially oriented sheet core and skin layers include polyolefins, polyesters, polyamides, polycarbonates, cellulosic esters, polystyrene, polyvinyl resins, polysulfonamides, polyethers, polyimides, polyvinylidene fluoride, polyurethanes, polyphenylenesulfides, polytetrafluoroethylene, polyacetals, polysulfonates, polyester ionomers, and polyolefin ionomers. Copolymers and/or mixtures of these polymers can be used.

Suitable polyolefins for the core and skin layers include polypropylene, polyethylene, polymethylpentene, and mixtures thereof. Polyolefin copolymers, including copolymers of propylene and ethylene, such as hexene, butene, and octene are also usefil. Polypropylenes are preferred because they are low in cost and have good strength and surface properties.

Suitable polyesters include those produced from aromatic, aliphatic, or cycloaliphatic dicarboxylic acids of 4–20 carbon atoms and aliphatic or alicyclic glycols having from 2–24 carbon atoms. Examples of suitable dicarboxylic acids include terephthalic, isophthalic, phthalic, naphthalene dicarboxylic acid, succinic, glutaric, adipic, azelaic, sebacic, fumaric, maleic, itaconic, 1,4-cyclohexanedicarboxylic, sodiosulfoisophthalic, and mixtures thereof. Examples of suitable glycols include ethylene glycol, propylene glycol, butanediol, pentanediol, hexanediol, 1,4-cyclohexanedimethanol, diethylene glycol, other polyethylene glycols, and mixtures thereof. Such polyesters are well known in the art and may be produced by well-known techniques, e.g., those described in U.S. Pat. Nos. 2,465,319 and 2,901,466. Preferred continuous matrix polyesters are those having repeat units from terephthalic acid or naphthalene dicarboxylic acid and at least one glycol selected from ethylene glycol, 1,4-butanediol and 1,4-cyclohexanedimethanol. Poly(ethylene terephthalate), which may be modified by small amounts of other monomers, is especially preferred. Other suitable polyesters include liquid crystal copolyesters formed by the inclusion of suitable amount of a co-acid component such as stilbene dicarboxylic acid. Examples of such liquid crystal copolyesters are those disclosed in U.S. Pat. Nos. 4,420,607; 4,459,402; and 4,468,510.

Useful polyamides include nylon 6, nylon 66, and mixtures thereof. Copolymers of polyamides are also suitable continuous phase polymers. An example of a useful polycarbonate is bisphenol-A polycarbonate. Cellulosic esters suitable for use as the continuous phase polymer of the composite sheets include cellulose nitrate, cellulose triacetate, cellulose diacetate, cellulose acetate propionate, cellulose acetate butyrate, and mixtures or copolymers thereof. Useful polyvinyl resins include polyvinyl chloride, poly(vinyl acetal), and mixtures thereof. Copolymers of vinyl resins can also be utilized.

The biaxially oriented sheet on the backside of the laminated base can be made with one or more layers of the same polymeric material, or it can be made with layers of different polymeric composition. In the case of a multiple layer system, when different polymeric materials are used, an additional layer may be required to promote adhesion between non-compatible polymeric materials so that the biaxially oriented sheets do not have layer fracture during manufacturing or in the final imaging element format.

The coextrusion, quenching, orienting, and heat setting of bottom biaxially oriented sheets may be effected by any process which is known in the art for producing oriented sheet, such as by a flat sheet process or a bubble or tubular process. The flat sheet process involves extruding or coextruding the blend through a slit die and rapidly quenching the extruded or coextruded web upon a chilled casting drum so that the polymer component(s) of the sheet are quenched below their solidification temperature. The quenched sheet is then biaxially oriented by stretching in mutually perpendicular directions at a temperature above the glass transition temperature of the polymer(s). The sheet may be stretched in one direction and then in a second direction, or may be simultaneously stretched in both directions. After the sheet has been stretched, it is heat set by heating to a temperature sufficient to crystallize the polymers, while restraining to some degree the sheet against retraction in both directions of stretching.

The surface roughness of biaxially oriented sheet or $R_a$ is a measure of relatively finely spaced surface irregularities such as those produced on the backside of photographic materials by the casting of polyethylene against a rough chilled roll. The surface roughness measurement is a measure of the maximum allowable roughness expressed in units of micrometers and by use of the symbol $R_a$. For the irregular profile of the backside of photographic materials of this invention, the roughness average, $R_a$, is the sum of the absolute value of the difference of each discrete data point from the average of all the data divided by the total number of points sampled.

Biaxially oriented polyolefin sheets commonly used in the packaging industry are commonly melt extruded and then orientated in both directions (machine direction and cross direction) to give the sheet desired mechanical strength properties. The process of biaxially orientation generally creates a surface roughness average of less than 0.23 $\mu$m. While a smooth surface has value in the packaging industry, use as a backside layer for photographic paper is limited. Laminated to the backside of the base paper, the biaxially oriented sheet must have a surface roughness average ($R_a$) greater than 0.30 $\mu$m to ensure efficient transport through the many types of photofinishing equipment that have been purchased and installed around the world. At surface roughness less that 0.30 $\mu$m, transport through the photofinishing equipment becomes less efficient. At surface roughness greater than 2.54 $\mu$m, the surface would become too rough causing transport problems in photofinishing equipment, and the rough backside surface would begin to emboss the silver halide emulsion as the material is wound in rolls.

The structure of a typical biaxially oriented sheet of this invention with the skin layer on the bottom of the photographic element is as follows:

Solid core containing one or more layers

Skin layer

Addenda may also be added to the biaxially oriented backside sheet to improve the whiteness of these sheets. This would include processes known in the art including adding a white pigment, such as titanium dioxide, barium sulfate, clay, or calcium carbonate. This would also include adding fluorescing agents which absorb energy in the UV region and emit light largely in the blue region, or other additives which would improve the physical properties of the sheet or the manufacturability of the sheet.

In order to successfully transport a photographic paper that contains a laminated biaxially oriented sheet with the desired surface roughness on the opposite side of the image layer, an antistatic coating on the bottommost layer is preferred. The antistat coating may contain any antistatic materials known in the art which are coated on photographic web materials to reduce static during the transport of photographic paper. The preferred surface resistivity of the antistat coat at 50% RH is less than $10^{-12}$ ohm/square.

These biaxially oriented sheets may be coated or treated after the coextrusion and orienting process or between casting and full orientation with any number of coatings which may be used to improve the properties of the sheets including printability, to provide a vapor barrier, to make them heat sealable, or to improve the adhesion to the support or to the photosensitive layers. Examples of this would be acrylic coatings for printability and coating polyvinylidene chloride for heat seal properties. Further examples include flame, plasma, or corona discharge treatment to improve printability or adhesion.

Photographic grade cellulose papers of the invention are preferred as a base for laminating biaxially oriented polyolefin sheets. In the case of silver halide photographic systems, suitable cellulose papers must not interact with the light sensitive emulsion layer. A photographic grade paper used in this invention must be "smooth" so as to not interfere with the viewing of images. The surface roughness of cellulose paper or $R_a$ is a measure of relatively finely spaced surface irregularities on the paper. The surface roughness measurement is a measure of the maximum allowable roughness height expressed in units of micrometers and by use of the symbol $R_a$. For the paper of this invention, long wavelength surface roughness or orange peel is of interest. For the irregular surface profile of the paper of this invention, a 0.95 cm diameter probe is used to measure the surface roughness of the paper and, thus, bridges all fine roughness detail. The preferred surface roughness of the paper is between 0.13 and 0.44 $\mu$m. At surface roughness greater than 0.44 $\mu$m, little improvement in image quality is observed when compared to current photographic papers. A cellulose paper surface roughness less than 0.13 $\mu$m is difficult to manufacture and costly.

The preferred basis weight of the cellulose paper of the invention is between 117.0 and 195.0 g/m$^2$. A basis weight less than 117.0 g/m$^2$ yields an imaging support that does not have the required stiffness for transport through photofinishing equipment and digital printing hardware. Additionally, a basis weight less than 117.0 g/m$^2$ yields an imaging support that does not have the required stiffness for consumer acceptance. At basis weights greater than 195.0 g/m$^2$, the imaging support stiffness, while acceptable to consumers, exceeds the stiffness requirement for efficient photofinishing. Problems such as the inability to be chopped and incomplete punches are common with a cellulose paper that exceeds 195.0 g/m$^2$ in basis weight. The preferred fiber length of the paper of this invention is between 0.40 and 0.58 mm. Fiber lengths are measured using an FS-200 Fiber Length Analyzer (Kajaani Automation Inc.). Fiber lengths less than 0.35 mm are difficult to achieve in manufacturing and, as a result, expensive. Because shorter fiber lengths generally result in an increase in paper modulus, paper fiber lengths less than 0.35 mm will result in a photographic paper that is very difficult to punch in photofinishing equipment. Paper fiber lengths greater than 0.62 mm do not show an improvement in surface smoothness.

The preferred density of the cellulose paper of this invention is between 1.05 and 1.20 g/cc. A sheet density less than 1.05 g/cc would not provide the smooth surface preferred by consumers. A sheet density that is greater than 1.20 g/cc would be difficult to manufacture requiring expensive calendering and a loss in machine efficiency.

The machine direction to cross direction modulus is critical to the quality of the imaging support, as the modulus ratio is a controlling factor in imaging element curl and a balanced stiffness in both the machine and cross directions. The preferred machine direction to cross direction modulus ratio is between 1.4 and 1.9. A modulus ratio of less than 1.4 is difficult to manufacture since the cellulose fibers tend to align primarily with the stock flow exiting the paper machine head box. This flow is in the machine direction and is only counteracted slightly by fourdrinier parameters. A modulus ratio greater than 1.9 does not provide the desired curl and stiffness improvements to the laminated imaging support.

A cellulose paper substantially free of $TiO_2$ is preferred, as the opacity of the imaging support can be accomplished by laminating a microvoided biaxially oriented sheet to the cellulose paper of this invention. The elimination of $TiO_2$ from the cellulose paper significantly improves the efficiency of the paper making process, eliminating the need for cleaning unwanted $TiO_2$ deposits on critical machine surfaces. However, if $TiO_2$ is desired to improve the opacity of the support, for example, then cellulose paper of this invention may contain any addenda known in the art to improve the imaging quality of the paper, including titanium dioxide. The $TiO_2$ used may be either anatase or rutile type. Examples of $TiO_2$ that are acceptable for addition in cellulose paper are DuPont Chemical Co. R101 rutile $TiO_2$ and DuPont Chemical Co. R104 rutile $TiO_2$. Other pigments to improve photographic responses may also be used in this invention, and pigments such as talc, kaolin, $CaCO_3$, $BaSO_4$, ZnO, $TiO_2$, ZnS, and $MgCO_3$ are useful and may be used alone or in combination with $TiO_2$.

A cellulose paper substantially free of dry strength resin and wet strength resin is preferred because the elimination of dry and wet strength resins reduces the cost of the cellulose paper and improves manufacturing efficiency. Dry strength and wet strength resins are commonly added to cellulose photographic paper to provide strength in the dry state and strength in the wet state as the paper is developed in wet processing chemistry during the photofinishing of consumer images. In this invention, dry and wet strength resin are no longer needed, as the strength of the imaging support is the result of laminating high strength biaxially oriented polymer sheets to the top and bottom of the cellulose paper.

Any pulps known in the art to provide image quality paper may be used in this invention. Bleached hardwood chemical kraft pulp is preferred, as it provides brightness, a good starting surface, and good formation while maintaining strength. In general, hardwood fibers are much shorter than softwood by approximately a 1:3 ratio. Pulp with a brightness less than 90% brightness at 457 nm is preferred. Pulps with brightness of 90% or greater are commonly used in imaging supports because consumers typically prefer a white paper appearance. A cellulose paper less than 90% brightness at 457 nm is preferred, as the whiteness of the imaging support can be improved by laminating a microvoided biaxially oriented sheet to the cellulose paper of this invention. The reduction in brightness of the pulp allows for a reduction in the amount of bleaching required, thus lowering the cost of the pulp and reducing the bleaching load on the environment.

The cellulose paper of this invention can be made on a standard continuous fourdrinier wire machine. For the formation of cellulose paper of this invention, it is necessary to refine the paper fibers to a high degree to obtain good formation. This is accomplished in this invention by providing wood fibers suspended in water, bringing said fibers into contact with a series of disc refining mixers and conical refining mixers such that fiber development in disc refining is carried out at a total specific net refining power of 44 to 66 KW hrs/metric ton and cutting in the conical mixers is carried out at a total specific net refining power of between 55 and 88 KW hrs/metric ton, applying said fibers in water to a foraminous member to remove water, drying said paper between press and felt, drying said paper between cans, applying a size to said paper, drying said paper between steam heated dryer cans, applying steam to said paper, and passing said paper through calender rolls. The preferred specific net refining power (SNRP) of cutting is between 66 and 77 KW hrs/metric ton. A SNRP of less than 66 KW hrs/metric ton will provide an inadequate fiber length reduction resulting in a less smooth surface. A SNRP of greater than 77 KW hrs/metric ton after disc refining described above generates a stock slurry that is difficult to drain liquid from on the fourdrinier wire. Specific Net Refiner Power is calculated by the following formula: (Applied Power in Kilowatts to the refiner−the No Load Kilowatts)/(0.251*% consistency*flow rate in gpm*0.907 metric tons/ton).

For the formation of cellulose paper of sufficient smoothness, it is desirable to rewet the paper surface prior final calendering. Papers made on the paper machine with a high moisture content calendar much more readily that papers of the same moisture content containing water added in a remoistening operation. This is due to a partial irreversibility in the imbition of water by cellulose. However, calendering a paper with high moisture content results blackening, a condition of transparency resulting from fibers being crushed in contact with each other. The crushed areas reflect less light and, therefore, appear dark, a condition that is undesirable in an imaging application such as a base for color photographic paper. By adding moisture to the surface of the paper after the paper has been machine dried, the problem of blackening can be avoided while preserving the advantages of high moisture calendering. The addition of surface moisture prior to machine calendering is intended to soften the surface fibers and not the fibers in the interior of the paper. Papers calendered with a high surface moisture content generally show greater strength, density, gloss, and processing chemistry resistance, all of which are desirable for an imaging support and have been shown to be perceptually preferred to prior art photographic paper bases.

There are several paper surface humidification/moisturization techniques. The application of water, either by mechanical roller or aerosol mist by way of a electrostatic field, are two techniques known in the art. The above techniques require dwell time, hence web length, for the water to penetrate the surface and equalize in the top surface of the paper. Therefore, it is difficult for these above systems to make moisture corrections without distorting, spotting, and swelling of the paper. The preferred method to rewet the paper surface prior final calendering is by use of a steam application device. A steam application device uses saturated steam in a controlled atmosphere to cause water vapor to penetrate the surface of the paper and condense. Prior to calendering, the steam application device allows a considerable improvement in gloss and smoothness due to the heating up and moisturizing the paper of this invention before the pressure nip of the calendering rolls. An example of a commercially available system that allows for controlled steam moisturization of the surface of cellulose paper is the "Fluidex System" manufactured by Pagendarm Corp. A preferred steam application or steam shower apparatus is the STEAM-FOIL of Thermo Electron Web System Incorporated.

Illustrated in FIG. I is a steam application device 14 at the end of paper machine 16. The paper 12 passing of machine 16 over drums 18 and 22 passes through the steam application device 14. In steam application device 14, high pressure steam penetrates the surface of the paper prior to its passing through the calendar stack 26 where the moisturized paper passes between rolls 28 and 32 and rolls 32 and 34 to form the improved smooth surface of the invention. A steam application device 14 may be adjusted by means not shown to inject steam into one or both surfaces of the paper.

For imaging supports, the use of steam on the face side of the paper only is preferred since improved surface smoothness has commercial value for the imaging side of the paper. Application of the steam application device to both sides of the paper, while feasible, is unnecessary and adds additional cost to the product.

The preferred moisture content by weight after applying the steam and calendering is between 7% and 9%. A moisture level less than 7% is more costly to manufacture since more fiber is needed to reach a final basis weight. At a moisture level greater than 10% the surface of the paper begins to degrade. After the steam application device rewetting of the paper surface, the paper is calendered before winding of the paper. The preferred temperature of the calender rolls is between 76° C. and 88° C. Lower temperatures result in a poor surface. Higher temperatures are unnecessary, as they do not improve the paper surface and require more energy.

When using a cellulose fiber paper support, it is preferable to extrusion laminate the microvoided composite sheets to the base paper using a polyolefin resin. Extrusion laminating is carried out by bringing together the biaxially oriented sheets of the invention and the base paper with application of an adhesive between them followed by their being pressed in a nip such as between two rollers. The adhesive may be applied to either the biaxially oriented sheets or the base paper prior to their being brought into the nip. In a preferred form the adhesive is applied into the nip simultaneously with the biaxially oriented sheets and the base paper. The adhesive may be any suitable material that does not have a harmful effect upon the photographic element. A preferred material is polyethylene that is melted at the time it is placed into the nip between the paper and the biaxially oriented sheet.

During the lamination process, it is desirable to maintain control of the tension of the biaxially oriented sheet(s) in order to minimize curl in the resulting laminated support. For high humidity applications (>50% RH) and low humidity applications (<20% RH), it is desirable to laminate both a front side and backside film to keep curl to a minimum. Also, during the lamination process, it is desirable to laminate the top sheet to the face side of the paper. Generally, the face side of the paper is a smoother surface than the wire side. Lamination of the top sheet to the face side of the paper will generally yield an image with better gloss than lamination of the top sheet to the wire side of the paper.

As used herein the phrase "imaging element" is a material that may be used as a laminated support for the transfer of images to the support by techniques such as ink jet printing or thermal dye transfer, as well as a support for silver halide images. As used herein, the phrase "photographic element" is a material that utilizes photosensitive silver halide in the formation of images. In the case of thermal dye transfer or ink jet, the image layer that is coated on the imaging element may be any material that is known in the art such as gelatin, pigmented latex, polyvinyl alcohol, polycarbonate, polyvinyl pyrrolidone, starch, and methacrylate. The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

The photographic emulsions useful for this invention are generally prepared by precipitating silver halide crystals in a colloidal matrix by methods conventional in the art. The colloid is typically a hydrophilic film forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed in the invention can be those methods known in the art.

Chemical sensitization of the emulsion typically employs sensitizers such as sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. As described, heat treatment is employed to complete chemical sensitization. Spectral sensitization is effected with a combination of dyes, which are designed for the wavelength range of interest within the visible or infrared spectrum. It is known to add such dyes both before and after heat treatment.

After spectral sensitization, the emulsion is coated on a support. Various coating techniques include dip coating, air knife coating, curtain coating, and extrusion coating.

The silver halide emulsions utilized in this invention may be comprised of any halide distribution. Thus, they may be comprised of silver chloride, silver chloroiodide, silver bromide, silver bromochloride, silver chlorobromide, silver iodochloride, silver iodobromide, silver bromoiodochloride, silver chloroiodobromide, silver iodobromochloride, and silver iodochlorobromide emulsions. It is preferred, however, that the emulsions be predominantly silver chloride emulsions. By predominantly silver chloride, it is meant that the grains of the emulsion are greater than about 50 mole percent silver chloride. Preferably, they are greater than about 90 mole percent silver chloride; and optimally greater than about 95 mole percent silver chloride.

The silver halide emulsions can contain grains of any size and morphology. Thus, the grains may take the form of cubes, octahedrons, cubo-octahedrons, or any of the other naturally occurring morphologies of cubic lattice type silver halide grains. Further, the grains may be irregular such as spherical grains or tabular grains. Grains having a tabular or cubic morphology are preferred.

The photographic elements of the invention may utilize emulsions as described in *The Theory of the Photographic Process,* Fourth Edition, T. H. James, Macmillan Publishing Company, Inc., 1977, pages 151–152. Reduction sensitization has been known to improve the photographic sensitivity of silver halide emulsions. While reduction sensitized silver halide emulsions generally exhibit good photographic speed, they often suffer from undesirable fog and poor storage stability.

Reduction sensitization can be performed intentionally by adding reduction sensitizers, chemicals which reduce silver ions to form metallic silver atoms, or by providing a reducing environment such as high pH (excess hydroxide ion) and/or low pAg (excess silver ion). During precipitation of a silver halide emulsion, unintentional reduction sensitization can occur when, for example, silver nitrate or alkali solutions are added rapidly or with poor mixing to form emulsion grains. Also, precipitation of silver halide emulsions in the presence of ripeners (grain growth modifiers) such as thioethers, selenoethers, thioureas, or ammonia tends to facilitate reduction sensitization.

Examples of reduction sensitizers and environments which may be used during precipitation or spectral/chemical sensitization to reduction sensitize an emulsion include ascorbic acid derivatives; tin compounds; polyamine compounds; and thiourea dioxide-based compounds described in U.S. Pat. Nos. 2,487,850; 2,512,925; and British Patent 789,823. Specific examples of reduction sensitizers or conditions, such as dimethylamineborane, stannous chloride, hydrazine, high pH (pH 8–11) and low pAg (pAg 1–7) ripening are discussed by S. Collier in Photographic Science and Engineering, 23, 113 (1979). Examples of processes for preparing intentionally reduction sensitized silver halide emulsions are described in EP 0 348 934 Al (Yamashita), EP 0 369 491 (Yamashita), EP 0 371 388 (Ohashi), EP 0 396 424 Al (Takada), EP 0 404 142 Al (Yamada), and EP 0 435 355 Al (Makino).

The photographic elements of this invention may use emulsions doped with Group VIII metals such as iridium, rhodium, osmium, and iron as described in *Research Disclosure,* September 1996, Item 38957, Section I, published by Kenneth Mason Publications, Ltd., Dudley Annex, 12*a* North Street, Emsworth, Hampshire PO10 7DQ, ENGLAND. Additionally, a general summary of the use of iridium in the sensitization of silver halide emulsions is contained in Carroll, "Iridium Sensitization: A Literature Review," Photographic Science and Engineering, Vol. 24, No. 6, 1980. A method of manufacturing a silver halide emulsion by chemically sensitizing the emulsion in the presence of an iridium salt and a photographic spectral sensitizing dye is described in U.S. Pat. No. 4,693,965. In some cases, when such dopants are incorporated, emulsions show an increased fresh fog and a lower contrast sensitometric curve when processed in the color reversal E-6 process as described in The British Journal of Photography Annual, 1982, pages 201–203.

A typical multicolor photographic element of the invention comprises the invention laminated support bearing a cyan dye image-forming unit comprising at least one red-sensitive silver halide emulsion layer having associated therewith at least one cyan dye-forming coupler; a magenta image-forming unit comprising at least one green-sensitive silver halide emulsion layer having associated therewith at least one magenta dye-forming coupler; and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like. The support of the invention may also be utilized for black-and-white photographic print elements.

The photographic elements may also contain a transparent magnetic recording layer such as a layer containing magnetic particles on the underside of a transparent support, as in U.S. Pat. Nos. 4,279,945 and 4,302,523. Typically, the element will have a total thickness (excluding the support) of from about 5 to about 30 $\mu$m.

The invention may be utilized with the materials disclosed in *Research Disclosure* 40145, September 1997. The invention is particularly suitable for use with the materials of the color paper examples of sections XVI and XVII. The couplers of section II are also particularly suitable. The Magenta I couplers of section II, particularly M-7, M-10, M-11, and M-18, are particularly desirable.

In the following Table, reference will be made to (1) *Research Disclosure,* December 1978, Item 17643, (2) *Research Disclosure,* December 1989, Item 308119, and (3) *Research Disclosure,* September 1996, Item 38957, all published by Kenneth Mason Publications, Ltd., Dudley Annex, 12a North Street, Emsworth, Hampshire PO10 7DQ, ENGLAND. The Table and the references cited in the Table are to be read as describing particular components suitable for use in the elements of the invention. The Table and its cited references also describe suitable ways of preparing, exposing, processing and manipulating the elements, and the images contained therein.

| Reference | Section | Subject Matter |
|---|---|---|
| 1 | I, II | Grain composition, |
| 2 | I, II, IX, X, | morphology and preparation. |

-continued

| Reference | Section | Subject Matter |
|---|---|---|
| 3 | XI, XII, XIV, XV I, II, III, IX A & B | Emulsion preparation including hardeners, coating aids, addenda, etc. |
| 1<br>2<br>3 | II, IV<br>III, IV<br>IV, V | Chemical sensitization and spectral sensitization/ desensitization |
| 1<br>2<br>3 | V<br>V<br>VI | UV dyes, optical brighteners, luminescent dyes |
| 1<br>2<br>3 | VI<br>VI<br>VII | Antifoggants and stabilizers |
| 1<br>2<br>3 | VIII<br>VIII, XIII,<br>XVI VIII, IX C & D | Absorbing and scattering materials; Antistatic layers; matting agents |
| 1<br>2<br>3 | VII<br>VII<br>X | Image-couplers and image-modifying couplers; Dye stabilizers and hue modifiers |
| 1<br>2<br>3 | XVII<br>XVII<br>XV | Supports |
| 3 | XI | Specific layer arrangements |
| 3 | XII, XIII | Negative working emulsions; Direct positive emulsions |
| 2<br>3 | XVIII<br>XVI | Exposure |
| 1<br>2<br>3 | XIX, XX<br>XIX, XX,<br>XXII XVIII, XIX, XX | Chemical processing; Developing agents |
| 3 | XIV | Scanning and digital processing procedures |

The photographic elements can be exposed with various forms of energy which encompass the ultraviolet, visible, and infrared regions of the electromagnetic spectrum, as well as with electron beam, beta radiation, gamma radiation, X ray, alpha particle, neutron radiation, and other forms of corpuscular and wave-like radiant energy in either noncoherent (random phase) forms or coherent (in phase) forms, as produced by lasers. When the photographic elements are intended to be exposed by X rays, they can include features found in conventional radiographic elements.

The photographic elements are preferably exposed to actinic radiation, typically in the visible region of the spectrum, to form a latent image, and then processed to form a visible image, preferably by other than heat treatment. Processing is preferably carried out in the known RA-4™ (Eastman Kodak Company) Process or other processing systems suitable for developing high chloride emulsions.

The laminated substrate of the invention may have copy restriction features incorporated such as disclosed in U.S. patent application Ser. No. 08/598,785 filed Feb. 8, 1996 and application Ser. No. 08/598,778 filed on the same day. These applications disclose rendering a document copy restrictive by embedding into the document a pattern of invisible microdots. These microdots are, however, detectable by the electro-optical scanning device of a digital document copier. The pattern of microdots may be incorporated throughout the document. Such documents may also have colored edges or an invisible microdot pattern on the backside to enable users or machines to read and identify the media. The media may take the form of sheets that are capable of bearing an image. Typical of such materials are photographic paper and film materials composed of polyethylene resin coated paper, polyester, (poly)ethylene naphthalate, and cellulose triacetate based materials.

The microdots can take any regular or irregular shape with a size smaller than the maximum size at which individual microdots are perceived sufficiently to decrease the usefulness of the image, and the minimum level is defined by the detection level of the scanning device. The microdots may be distributed in a regular or irregular array with center-to-center spacing controlled to avoid increases in document density. The microdots can be of any hue, brightness, and saturation that does not lead to sufficient detection by casual observation, but preferably of a hue least resolvable by the human eye, yet suitable to conform to the sensitivities of the document scanning device for optimal detection.

In one embodiment the information-bearing document is comprised of a support, an image-forming layer coated on the support and pattern of microdots positioned between the support, and the image-forming layer to provide a copy restrictive medium. Incorporation of the microdot pattern into the document medium can be achieved by various printing technologies either before or after production of the original document. The microdots can be composed of any colored substance, although depending on the nature of the document, the colorants may be translucent, transparent, or opaque. It is preferred to locate the microdot pattern on the support layer prior to application of the protective layer, unless the protective layer contains light scattering pigments. Then the microdots should be located above such layers and preferably coated with a protective layer. The microdots can be composed of colorants chosen from image dyes and filter dyes known in the photographic art and dispersed in a binder or carrier used for printing inks or light-sensitive media.

In a preferred embodiment the creation of the microdot pattern as a latent image is possible through appropriate temporal, spatial, and spectral exposure of the photosensitive materials to visible or non-visible wavelengths of electromagnetic radiation. The latent image microdot pattern can be rendered detectable by employing standard photographic chemical processing. The microdots are particularly useful for both color and black-and-white image-forming photographic media. Such photographic media will contain at least one silver halide radiation sensitive layer, although typically such photographic media contain at least three silver halide radiation sensitive layers. It is also possible that such media contain more than one layer sensitive to the same region of radiation. The arrangement of the layers may take any of the forms known to one skilled in the art, as discussed in *Research Disclosure* 37038 of February 1995.

The following examples illustrate the practice of this invention. They are not intended to be exhaustive of all possible variations of the invention. Parts and percentages are by weight unless otherwise indicated.

EXAMPLES

Example 1

Paper bases A1 and B1 for this example were all formed as follows:

Paper stocks were produced for the imaged support using a standard fourdrinier paper machine and a blend of mostly bleached hardwood Kraft fibers. The fiber ratio consisted primarily of bleached poplar (38%)and maple/beech (37%) with lesser amounts of birch (18%) and softwood (7%). Fiber length was reduced from 0.73 mm length weighted average as measured by a Kajaani FS-200 to the levels listed in Table 1 using high levels of conical refining and low levels of disc refining. Fiber lengths from slurry generated in parts A1 and B1 were measured using a FS-200 Fiber Length Analyzer (Kajaani Automation Inc.). Energy applied to the fibers is indicated by the total Specific Net Refining Power (SNRP) also listed in Table 1. Two conical refiners were used in series to provide the total conical refiners SNRP value. This value was obtained by adding the SNRPs of each conical refiner. Two disc refiners were similarly used in series to provide a total Disk SNRP. Neutral sizing chemical addenda, utilized on a dry weight basis, included alkyl ketene dimer at 0.20% addition, cationic starch (1.0%), polyaminoamide epichlorhydrin (0.50%), polyacrylamide resin (0.18%), diaminostilbene optical brightener (0.20%), and sodium bicarbonate. Surface sizing using hydroxyethylated starch and sodium chloride was also employed but is not critical to the invention. In the 3$^{rd}$ Dryer section, ratio drying was utilized to provide a moisture bias from the face side to the wire side of the sheet. The face side (emulsion side) of the sheet was then remoisturized with conditioned steam immediately prior calendering. Sheet temperatures were raised to between 76° C. and 93° C. just prior to and during calendering. The paper was then calendered to an apparent density of 1.17 for paper base A1 and 1.06 for paper base B1. Moisture levels after the calender were 7.0% to 9.0% by weight.

Paper bases A1 and B1 differ from each other as follows:

Paper Base A1(Invention)

Paper base A1 was produced at a basis weight of 178 g/mm$^2$ and thickness of 0.1524 mm.

Paper Base B1 (Invention)

Paper base B1 was produced at a basis weight of 127 g/m$^2$ and thickness of 0.1194 mm.

Paper Base C1 (Control)

Provides a comparison of typical photographic paper base. Paper base C1 incorporates the same raw materials at a basis weight of 170 g/m$^2$ and a thickness of 0.163 mm; however, substantially less conical refining is used, and there is no steam treatment prior to calendering compared to typical photographic paper base.

TABLE 1

| Base Sample | Apparent Density | Total Jordan SNRP (KW hr/metric ton) | Total Disc SNRP (KW hr/metric ton) | Total Combined SNRP (Kw hrs/metric ton) | Fiber Weighted Average Length (mm) |
|---|---|---|---|---|---|
| A1 | 1.17 | 72 | 55 | 127 | 0.50 |
| B1 | 1.06 | 60 | 55 | 115 | 0.55 |
| C1 | 1.04 | 33 | 55 | 88 | 0.60 |

Composite photographic bases A–C were prepared by melt extrusion laminating biaxially oriented sheets to the face side and wire sides of photographic paper bases A1–C1. The photographic bases were prepared by extrusion lamination using a slit die and 1924P Low Density Polyethylene (Eastman Chemical Co.) which is an extrusion grade low density polyethylene with a density of 0.923 g/cm$^3$ and a melt index of 4.2 to adhere the biaxially oriented sheets of this example to the paper. The biaxially oriented sheets used in this example are:

Top sheet:

(Laminated to the face side of the paper) OPPalyte 350 ASW (Mobil Chemical Co.)

A composite sheet (31 $\mu$m thick) (d=0.68 g/cc) consisting of a microvoided and oriented polypropylene core (approximately 60% of the total sheet thickness), with a homopolymer non-microvoided oriented polypropylene layer on each side; the void initiating material used is poly(butylene terephthalate).

Bottom sheet:

(Laminated to the wire side of the paper) BICOR 70 MLT (Mobil Chemical Co.)

A one-side matte finish, one-side Corona Discharge treated polypropylene sheet (18 $\mu$m thick) (d=0.9 g/cc) consisting of a solid oriented polypropylene sheet with a skin surface layer. The polypropylene sheet was laminated against the paper exposing the matte surface of the skin layer. The skin layer is a mixture of polyethylenes and a terpolymer of ethylene-propylene-butylene.

The imaging support structure for imaging supports A, B and C was as follows:

OPPalyte 350 ASW
Low density polyethylene
Base papers A1–C1 (features)
Low density polyethylene
BICOR 70 MLT Coating format 1 was utilized to prepare photographic print materials utilizing photographic supports A–C.

| | Coating Format 1 | Laydown mg/m$^2$ |
|---|---|---|
| Layer 1 | Blue Sensitive Layer | |
| | Gelatin | 1300 |
| | Blue sensitive silver | 200 |
| | Y-1 | 440 |
| | ST-1 | 440 |
| | S-1 | 190 |
| Layer 2 | Interlayer | |
| | Gelatin | 650 |
| | SC-1 | 55 |
| | S-1 | 160 |
| Layer 3 | Green Sensitive | |
| | Gelatin | 1100 |
| | Green sensitive silver | 70 |
| | M-1 | 270 |
| | S-1 | 75 |
| | S-2 | 32 |
| | ST-2 | 20 |
| | ST-3 | 165 |
| | ST-4 | 530 |
| Layer 4 | UV Interlayer | |
| | Gelatin | 635 |
| | UV-1 | 30 |
| | UV-2 | 160 |
| | SC-1 | 50 |
| | S-3 | 30 |
| | S-1 | 30 |
| Layer 5 | Red Sensitive Layer | |
| | Gelatin | 1200 |
| | Red sensitive silver | 170 |
| | C-1 | 365 |
| | S-1 | 360 |
| | UV-2 | 235 |
| | S-4 | 30 |
| | SC-1 | 3 |
| Layer 6 | UV Overcoat | |
| | Gelatin | 440 |
| | UV-1 | 20 |
| | UV-2 | 110 |
| | SC-1 | 30 |
| | S-3 | 20 |
| | S-1 | 20 |
| Layer 7 | SOC | |
| | Gelatin | 490 |
| | SC-1 | 17 |

-continued

| Coating Format 1 | Laydown mg/m$^2$ |
|---|---|
| $SiO_2$ | 200 |
| Surfactant | 2 |

APPENDIX

Y-1

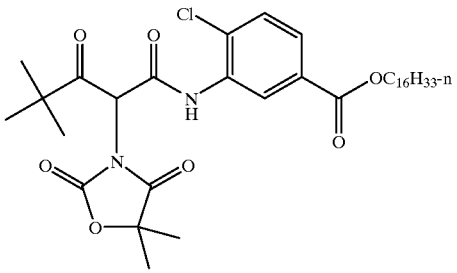

ST-1 = N-tert-butylacrylamide/n-butyl acrylate copolymer (50:50)

S-1 = dibutyl phthalate

SC-1

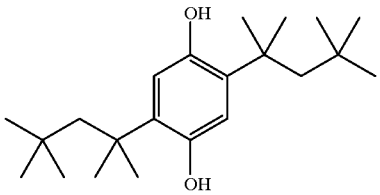

M-1

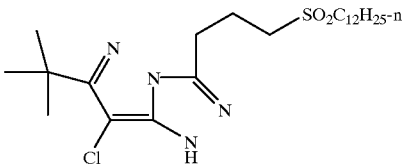

S-2 = diundecyl phthalate

ST-2

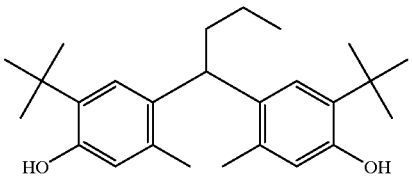

ST-3

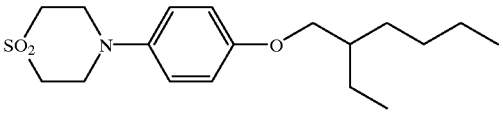

ST-4

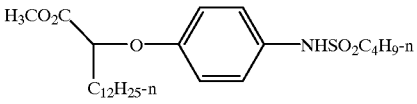

-continued

UV-1

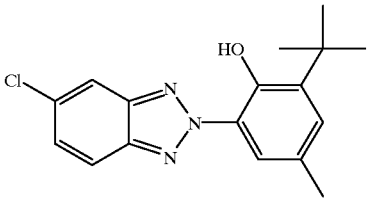

UV-2

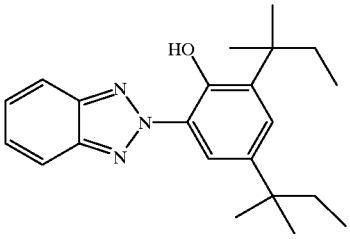

S-3 = 1,4-Cyclohexyldimethylene bis(2-ethylhexanoate)

C-1

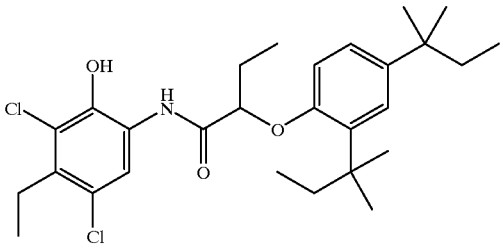

S-4 = 2-(2-Butoxyethoxy)ethyl acetate

Dye 1

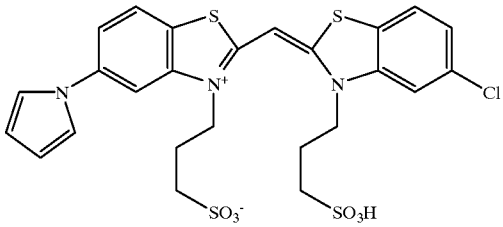

The surface roughness of the emulsion side of each photographic base variation was measured by a Federal Profiler at three stages of sample preparation, in the paper base form, after extrusion lamination and after silver halide emulsion coating. The Federal Profiler instrument consists of a motorized drive nip which is tangent to the top surface of the base plate. The sample to be measured is placed on the base plate and fed through the nip. A micrometer assembly is suspended above the base plate. The end of the mic spindle provides a reference surface from which the sample thickness can be measured. This flat surface is 0.95 cm diameter and, thus, bridges all fine roughness detail on the upper surface of the sample. Directly below the spindle, and nominally flush with the base plate surface, is a moving hemispherical stylus of the gauge head. This stylus responds to local surface variation as the sample is transported through the gauge. The stylus radius relates to the spatial content that can be sensed. The output of the gauge amplifier is digitized to 12 bits. The sample rate is 500 measurements per 2.5 cm. The roughness averages of 10 data points for each base variation is listed in Table 2.

TABLE 2

| Photographic Support | Paper Base Roughness (micrometers) | Laminated Support Roughness (micrometers) | Emulsion Coated Roughness (micrometers) |
|---|---|---|---|
| A | 0.23 | 0.24 | 0.23 |
| B | 0.41 | 0.43 | 0.42 |
| C | 0.54 | 0.56 | 0.54 |

The surface roughness results in Table 2 show that by increasing the amount of refining and by the use of a steam application device (photographic supports A and B), the surface roughness of photographic paper can be reduced. The surface roughness average reduction in the base paper resulted in a surface roughness average reduction in silver halide emulsion coated samples. The surface roughness average reduction in the imaging element resulted in significant perceptually preferred improvement in the gloss of the photographic paper. This result is significant in that the orange peel in photographic support C has been reduced well beyond what is currently capable with traditional photographic paper bases. An imaging paper base with a surface roughness between 0.20 and 0.40 $\mu$m has significant commercial value for consumers that prefer glossy images.

The invention has been described in detail with particular reference to certain preferred embodiments thereof, but it will be understood that variations and modifications can be effected within the spirit and scope of the invention.

What is claimed is:

1. A method of forming paper comprising in order providing wood fibers, said wood fibers comprising blended hardwood chemical kraft pulp, suspended in water, bringing said fibers into contact with a series of disc refining mixers and conical refining mixers such that fiber development in disc refining is carried out at a total specific net refining power of 44 to 66 KW hrs/metric ton of fiber and resulting in fiber length reduction to 0.4 to 0.58 mm in the conical refiners is carried out in a total specific net refining power of between 55 and 88 KW hrs/metric ton of fiber, applying said fibers in water to a foraminous member to remove water, partially drying said paper between press and felt, drying said paper between dryer cans, applying a size to said paper, drying said paper between dryer cans, applying steam to said paper, and passing said paper through calender rolls to form a paper having a surface roughness average of between 0.13 and 0.44 $\mu$m.

2. The method of claim 1 wherein the cutting is at a specific net refining power of between 66 and 77 KW hrs/metric ton of fiber.

3. The method of claim 1 wherein disc refining is at a specific net refining power of between 47 and 53 KW hrs/metric ton of fiber.

4. The method of claim 1 wherein said paper is at a moisture content of between 7 and 9 percent by weight after applying steam and after calendering.

5. The method of claim 1 wherein said calender rolls are maintained at a temperature such that said paper is heated to between 76° C. and 88° C. when it passes between said rolls.

6. The method of claim 1 wherein said paper fibers suspended in water are free of titanium dioxide.

7. The method of claim 1 wherein the method does not include the addition of dry strength resin, wet strength resin, or titanium dioxide.

8. The method of claim 1 wherein said pulp has a brightness of less than 90% brightness at 457 nm.

9. The method of claim 1 wherein the average fiber length of the individual fibers of said paper is between 0.40 and 0.58 mm.

* * * * *